US005743448A

United States Patent [19]

Tsai

[11] Patent Number: 5,743,448

[45] Date of Patent: Apr. 28, 1998

[54] RAINCOAT CONCEALING BACKPACK

[76] Inventor: Cheng-Chung Tsai, 5Fl-2, No. 163, Sec.2, Keelung Rd., Taipei, Taiwan

[21] Appl. No.: 784,466

[22] Filed: Jan. 16, 1997

[30] Foreign Application Priority Data

May 31, 1996 [TW] Taiwan ..... 85208157

[51] Int. Cl.[6] ..... A45F 4/02

[52] U.S. Cl. ..... 224/153; 224/576; 2/94; 2/69.5

[58] Field of Search ..... 224/153, 576, 224/577, 160; 2/94, 69, 69.5, 88, 89, 84

[56] References Cited

U.S. PATENT DOCUMENTS

| | | | |
|---|---|---|---|
| 4,389,735 | 6/1983 | McLaughlin | 2/94 |
| 4,563,777 | 1/1986 | Park | 2/94 |
| 4,689,831 | 9/1987 | Greenberger et al. | 2/94 |
| 5,123,117 | 6/1992 | Prendergast | 2/94 |
| 5,165,111 | 11/1992 | Leiberman | 2/94 |
| 5,407,112 | 4/1995 | Christodoulou et al. | 224/153 |
| 5,609,279 | 3/1997 | O'Shea | 224/160 |

FOREIGN PATENT DOCUMENTS

| | | | |
|---|---|---|---|
| 2948713 | 6/1981 | Germany | 224/153 |

*Primary Examiner*—Henry J. Recla
*Assistant Examiner*—Gregory M. Vidovich
*Attorney, Agent, or Firm*—Pro-Techtor International

[57] ABSTRACT

A raincoat concealing backpack with a structure that integrates as an unit both the raincoat and the shoulder-carry style backpack. The main body of the shoulder-carry style backpack is made from flexible fabric. The backpack includes a pair of straps, and a zipper is located on the perimeter of the front surface of the backpack. The zipper can be pulled open to expose a secondary interior surface, and a raincoat is sewed onto the secondary interior surface. The back side of the raincoat is equipped with a containing pouch.

4 Claims, 5 Drawing Sheets

RAINCOAT CONCEALING BACKPACK

FIELD OF THE INVENTION

The present invention relates to a raincoat concealing type backpack that has a raincoat and a backpack sewn together as an unit. The raincoat can be concealed inside a layer of the backpack. When the raincoat is worn, the backpack can be carried on the back. If smaller objects are placed in the backpack, the backpack can be placed inside a containing pouch. The backpack is very suitable for mountain climbing, hiking, traveling, and motorcycle riding.

BACKGROUND OF INVENTION

The present invention is a backpack which conceals a raincoat. The main structure utilizes a zipper located in the perimeter of the front surface, the surface of the backpack without shoulder straps. Inside the front surface and a secondary interior surface, the backpack contains a raincoat that is sewn onto the secondary interior surface. The backpack can still be worn on the shoulder while the raincoat is being worn. The backpack can also be placed into a containing pouch located on the back of the raincoat.

Generally, people view a raincoat and a backpack as two completely unrelated objects, i.e., a raincoat is a raincoat, a backpack is a backpack. When there is a need for a raincoat, the raincoat is packed inside the backpack. But frequently after using the raincoat, the backpack is soaking wet. Not only is it difficult to fold the raincoat, it cannot be placed back into the backpack, as it will get other items in the backpack wet.

Moreover, when people are traveling or motorcycle riding or cycling, they will often forget or overlook their raincoat. Therefore, if a raincoat and a backpack can be integrated as a unit, it is bound to be a great benefit to the user.

DETAILED DESCRIPTION OF THE PREFERRED EMBODIMENT

Figure 1:
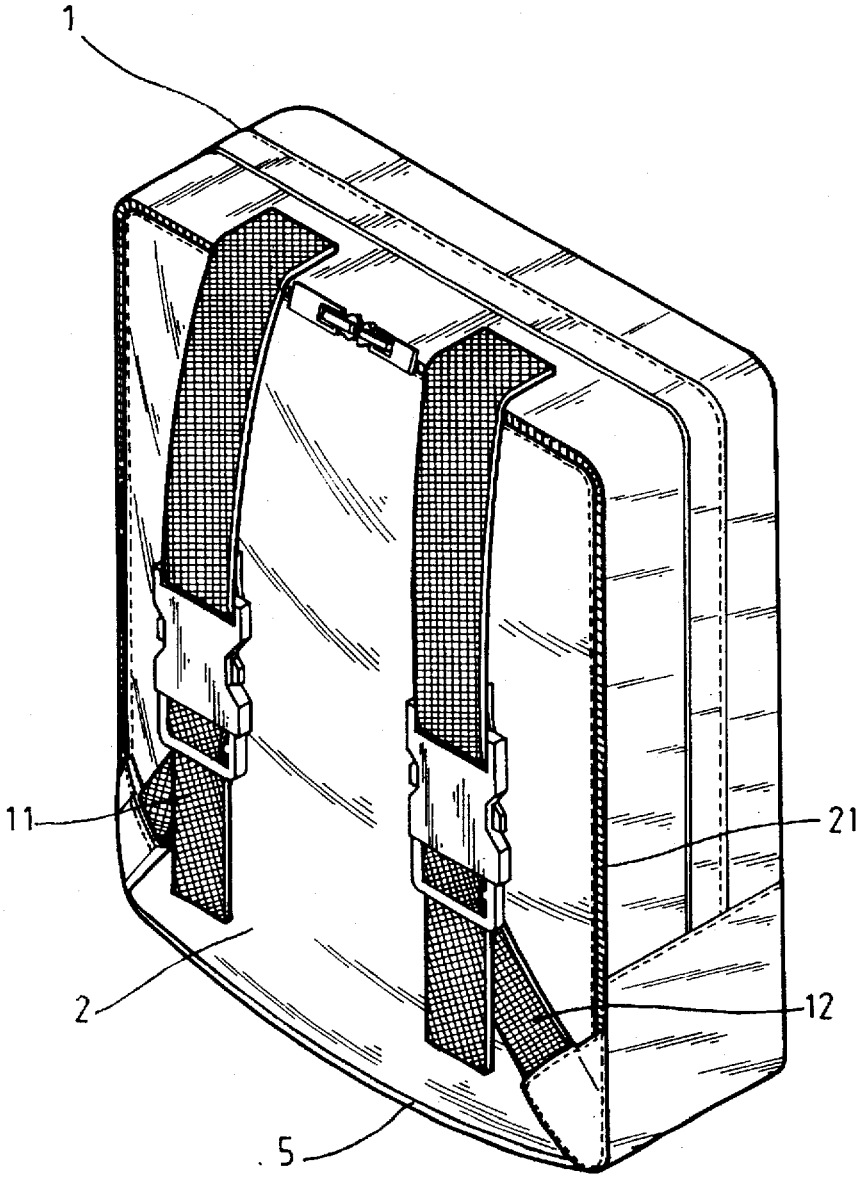
FIG. 1 is a perspective view of the present invention with the raincoat concealed.

Referring first to FIG. 1, a perspective view of the present invention with the raincoat concealed, a backpack (1) comprises a pair of shoulder straps (11) and (12). A front surface (2) of the backpack (1) generally lies against the back of the user, and includes a perimeter zipper (21). When the zipper (21) is pulled open, the interior surface (2) can be pulled downward.

Figure 2:
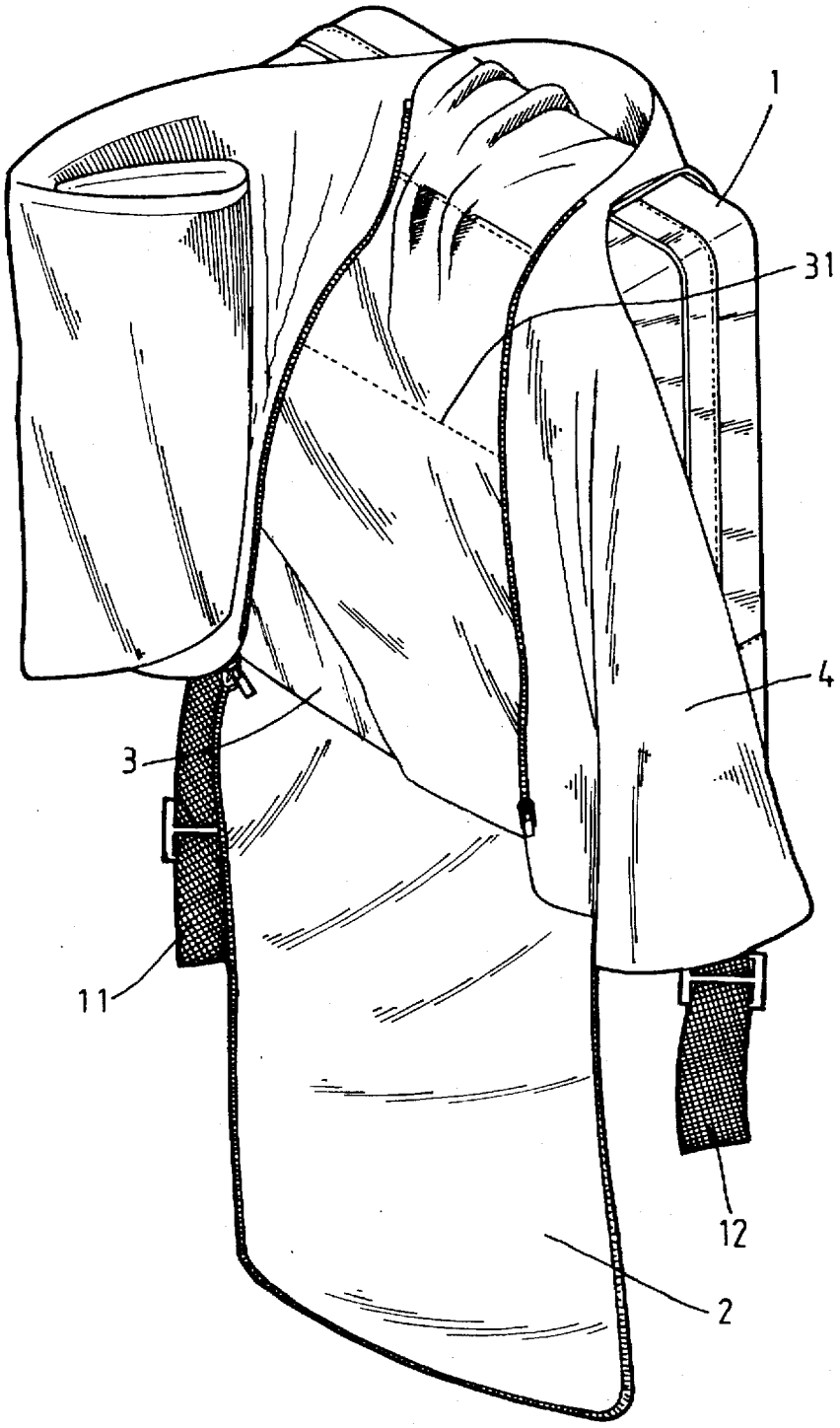
FIG. 2 is an illustration of the present invention with the raincoat opened.

Referring now to FIG. 2, there is a secondary interior surface (3) inside of the front surface (2). The front surface (2) and the secondary interior surface (3) form a single surface when open. A back side of a raincoat (4) is sewn onto the secondary interior surface (3). The seam (31) is located near a top of the interior surface (3). When the user is not wearing the raincoat (4), the raincoat (4) can be folded inward and stored between the front surface (2) and the secondary surface (3) ( as shown in FIG. 1). The raincoat (4) is completely hidden in this position.

Figure 3:
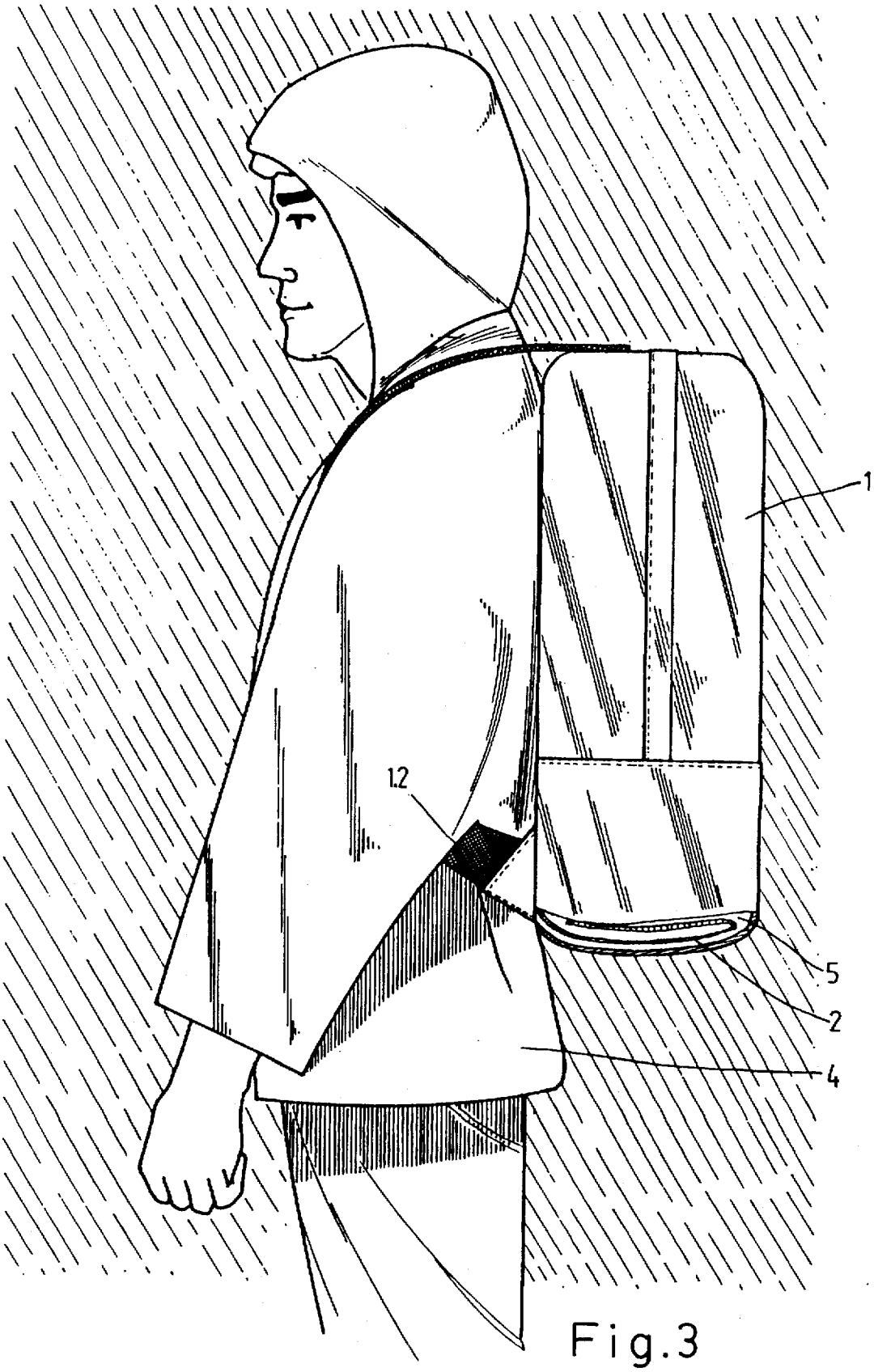
FIG. 3 is an illustration of the present invention in use.

When the user needs the raincoat (4), the user simply opens the zipper (21), and pulls out the raincoat (4). Meanwhile the front surface (2) drops naturally, with the front side of the raincoat (4) facing toward the user. Therefore, when the user wears the raincoat (4), the backpack (1) can still be positioned on the back of the user (as shown in FIG. 3). The bottom of the backpack (1) is equipped with a folded layer (5) with an opening toward the front surface (2). The folded layer (5) conceals the front surface (2).

Figure 4:
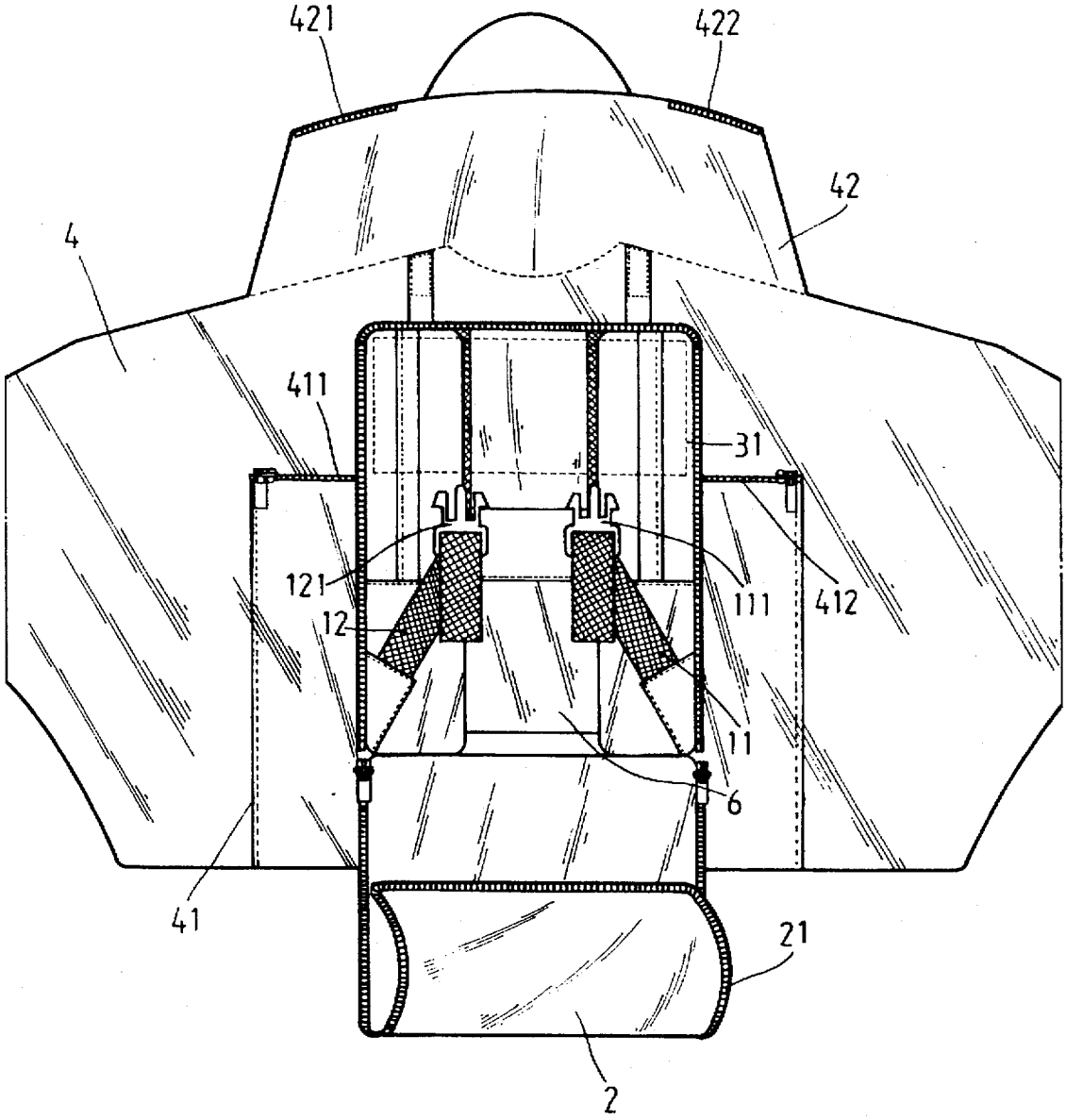
FIG. 4 is a back view of the raincoat before the backpack is stowed into a container pouch equipped on the raincoat.

Referring now to FIG. 4, which illustrates the front side (the side without shoulder straps) of the backpack (1), the exterior of the backside of the raincoat (4) is equipped with a containing pouch (41) with its opening facing upward. The top opening of this containing pouch (41) is positioned below the seam (31) of the raincoat (4) and the secondary interior surface (3). The opening of this containing pouch (41) is equipped with two single-sided zippers (411) and (412). The shoulder section of the raincoat (4) is equipped with a cover (42). This cover (42) conforms to the shape and positioning of the containing pouch (41). The bottom edge of the cover (42) includes two other single-sided zippers (421) and (422) that correspond to the single-sided zippers (411) and (412). The zippers enable the cover (42) and the containing pouch (41) to be zipped together.

Figure 5:
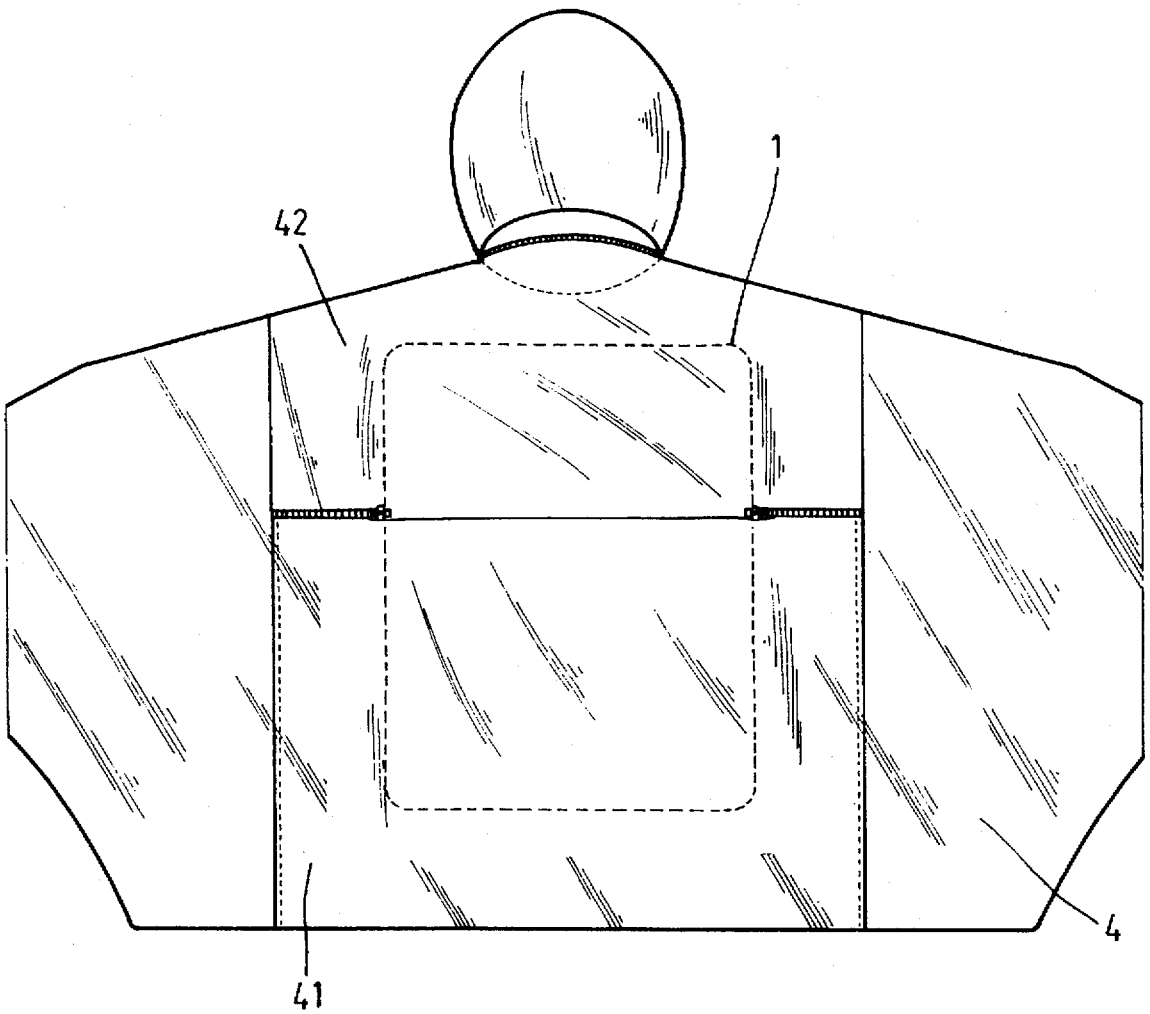
FIG. 5 is an illustration the raincoat with the backpack concealed in the pouch.

When smaller objects are placed inside the backpack, the backpack can be placed inside the containing pouch (41) through the following steps: First unbuckle the two buckles (111) and (121)that attach the shoulder straps (11) and (12) respectively, and put them on the exterior side (6) of the backpack (1). Then continuously flatten the backpack (1), as well as roll upward the front surface (2) until it reaches the exterior side (6). Then zip up the zipper (21). That will enable the shoulder straps (11) and (12) to be completely concealed between the interior surface (2) and the exterior side (6). Finally, stuff the bottom portion of the backpack into the containing pouch (41), and zip together the cover (42) and the containing pouch (41). The backpack then can be completely concealed inside the raincoat (4) (as shown in FIG. 5).

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A raincoat concealing backpack comprising:

a backpack including a pair of shoulder straps, a front surface of said backpack includes a peripheral zipper along two lateral sides and a top side of said backpack, opening said peripheral zipper allows said front surface of said backpack to fold down, inside said front surface, a secondary interior surface has a raincoat affixed thereto, said raincoat is stored between said front surface and said secondary interior surface such that said raincoat is deployed by a user opening said peripheral zipper; and a rear exterior of said raincoat includes a containing pouch, an upper edge of said containing pouch is positioned below a seam joining said raincoat and said secondary interior surface of said backpack, and an opening of said containing pouch comprises two single-sided zippers, a cover is included on said rear exterior of said raincoat, said cover corresponds in position to said containing pouch, a lower portion of said cover includes two single-sided zippers that correspond to said two single-sided zippers of said containing pouch; such that said two single-sided zippers of said containing pouch mate with said two single-sided zippers of said cover to affix said cover to said containing pouch so that said backpack can be placed inside the containing pouch and said cover covers said backpack while a user wears said raincoat.

2. The raincoat concealing backpack defined in claim 1 wherein:

a back side of said raincoat is sewn to said backpack.

3. The raincoat concealing backpack defined in claim 1 wherein:

said seam between said raincoat and said secondary interior surface is near a top side of said secondary interior surface.

4. The raincoat concealing backpack defined in claim 1 wherein:

said backpack includes a folded layer wherein said backpack may alternatively remain outside of said containing pouch and said front surface, after being folded down, may be positioned in said folded layer.

* * * * *